United States Patent [19]

Müller et al.

[11] 4,434,586

[45] Mar. 6, 1984

[54] MACHINE TOOL, ESPECIALLY A HAND-HELD POWER TOOL WITH A TURNABLE CLAMPING ELEMENT FOR CLAMPING A TOOL ON THE TOOL SPINDLE

[75] Inventors: Thomas Müller, Erlangen; Fritz Schädlich; Manfred Stäbler, both of Leinfelden-Echterdingen, all of Fed. Rep. of Germany

[73] Assignee: Robert Bosch GmbH, Stuttgart, Fed. Rep. of Germany

[21] Appl. No.: 212,681

[22] Filed: Dec. 3, 1980

[51] Int. Cl.[3] ..... B24B 23/02

[52] U.S. Cl. ..... 51/170 PT; 51/168

[58] Field of Search ..... 51/168, 170 PT, 170 R

[56] References Cited

U.S. PATENT DOCUMENTS 1,623,520 4/1927 Bennington ..... 51/273

FOREIGN PATENT DOCUMENTS 1103181 7/1955 Fed. Rep. of Germany .
1103804 3/1961 Fed. Rep. of Germany .
2816398 10/1979 Fed. Rep. of Germany ..... 51/168

*Primary Examiner*—Roscoe V. Parker
*Attorney, Agent, or Firm*—Michael J. Striker

[57] ABSTRACT

A machine tool, especially a hand-held power tool, comprises a tool spindle and a clamping element turnably mounted on the spindle, in which the turnable clamping element is arrestable during rotation of the spindle for clamping or releasing a tool mounted thereon to thereby make a separate implement for preventing rotation of the clamping element during clamping or releasing the tool on the spindle unnecessary. In a special embodiment of the present invention the clamping or releasing forces during change of the tool are mechanically applied and the turning moment during clamping of the tool is limited to a predetermined value.

18 Claims, 6 Drawing Figures

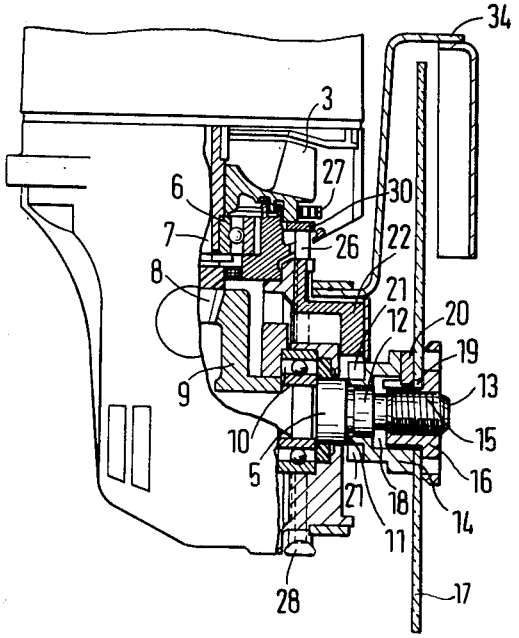
FIG.2
FIG.3
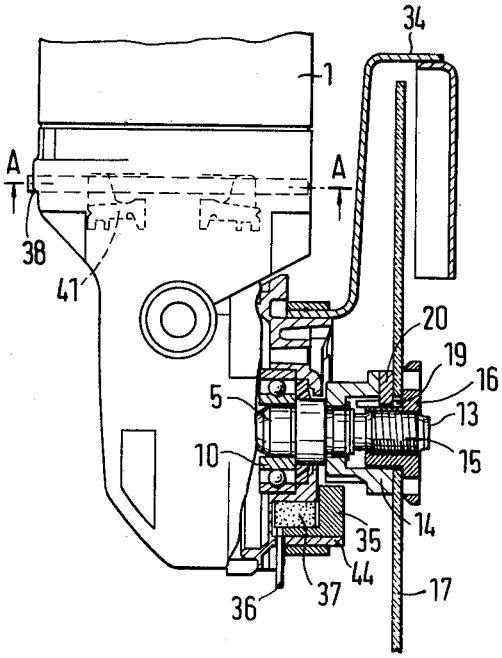
FIG.4
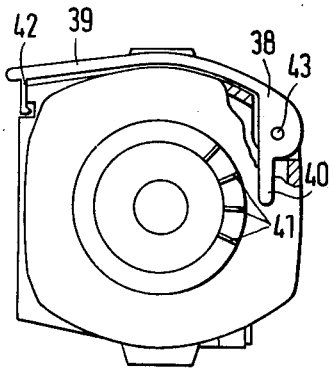

MACHINE TOOL, ESPECIALLY A HAND-HELD POWER TOOL WITH A TURNABLE CLAMPING ELEMENT FOR CLAMPING A TOOL ON THE TOOL SPINDLE

BACKGROUND OF THE INVENTION

The present invention relates to machine tools, especially a hand-held power tool having a turnable clamping element for clamping a tool on the tool spindle. Such machine tools are known in the art and, for instance, disclosed in the German Auslegeschrifts Nos. 11 03 181 and 11 03 804. The tools used in these machine tools are clamped on the tool spindle by means of a usually hand-operated key, so as to clamp a for instance disk-shaped tool by means of a clamping nut and a clamping flange. For clamping a special key is necessary in certain cases also a tool for holding the tool spindle stationary during the clamping of the tool thereon. Such tools for clamping the tool on the tool spindle, which are used only occasionally, can get lost, or at least they are quite often not available when their use becomes necessary.

SUMMARY OF THE INVENTION

It is an object of the present invention to provide a machine tool in which no separate tools are necessary for clamping the tool of the machine tool on the spindle of the latter.

It is an additional object of the present invention to provide a machine tool of this kind which is composed of relatively few and simple parts so as to stand up properly under extended use.

With these and other objects in view, which will become apparent as the description proceeds, the machine tool, especially a hand-held power tool, according to the present invention mainly comprises a housing, a tool spindle mounted in the housing for rotation about its axis, means on the tool spindle including a clamping element turnably mounted on the spindle for clamping a tool on the latter for rotation therewith, means for turning the spindle about its axis, and arresting means movable between a rest position and an arresting position for holding said clamping element against rotation during turning of the spindle for clamping or releasing the tool.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 2 is a partially sectioned side view of a portion of the embodiment shown in FIG. 1;

FIG. 3 is a partially sectioned side view similar to FIG. 2 of a second embodiment;

FIG. 4 is a section taken along the line A—A of FIG. 3;

DESCRIPTION OF THE PREFERRED EMBODIMENTS

Figure 1:
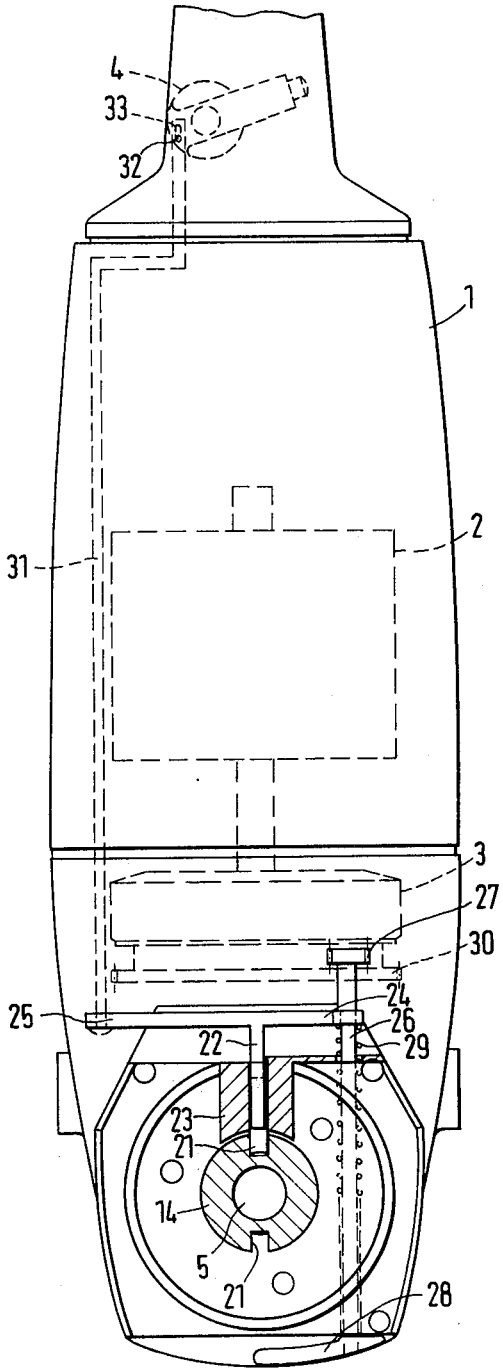
FIG. 1 is a partially sectioned front view of a first embodiment according to the present invention.

Referring now to the drawing, and more specifically to FIGS. 1 and 2, in which a first embodiment of the machine tool according to the present invention is illustrated, it will be seen that this machine tool comprises a housing 1 in which an electric drive motor 2, only schematically indicated in FIG. 1, is mounted in any convenient manner, to the drive shaft of which a ventilator 3 is connected. FIG. 1 shows also a switch 4 for connecting and disconnecting the electric motor a. The end of the motor drive shaft 7 which is rotatably mounted in a ball bearing 6 carries a bevel gear 8 which meshes with the teeth of a second bevel gear 9 fixedly mounted on a tool spindle 5 extending normal to the drive shaft 7. The tool spindle 5 is mounted for rotation in a ball bearing 10 and forms by means of a large-diameter portion thereon a shoulder face 11. A spindle tenon 13 projecting outwardly from the tool spindle 5 carries a clamping flange 14 and a clamping nut 16 is screwed onto the outer threaded portion 15 of the tenon 13. The clamping nut 16 passes through a bore in a cutting disk 17 located between the clamping flange 14 and the clamping nut and extends in a bore 18 in the clamping flange 14. The clamping nut 16 is provided with a longitudinal groove 19 into which an entrainment pin 20 extends, which is press-fitted in a radial bore of the clamping flange 14. The clamping flange 14 and the clamping nut 16 are thus connected for simultaneous rotation while being axially movable relative to each other to clamp the cutting disk 17 therebetween. The clamping flange 14 is provided at the region of its end facing away from the clamping nut 16 with two oppositely located locking grooves 21. A locking slide 22 which is mounted in a guide 23 fixed to the housing 1 movable in a direction normal to the axis of the tool spindle 5 is arranged for engagement in one of the locking grooves 21. The locking slide 22 is provided, as best shown in FIG. 1, with two transverse arms 24 and 25. The arm 24 is connected with a shaft 26, which likewise is guided in the housing 1 for movement in axial direction and a pinion 27 is connected to one end of the shaft 26, whereas a handle 28 is connected to the other end thereof. The locking slide and the shaft 26 are subjected to the action of a coil spring 29 constructed and arranged to bias the locking slide in a direction in which its lower end is out of engagement with the grooves 21 in the clamping flange and in which the handle 28 on the shaft 26 engages a portion of the housing 1 as shown in FIG. 1. In the position of the shaft 26, as shown in FIG. 1, the pinion 27 at one end of the shaft is out of engagement with a gear ring 30 which is fixedly connected to an end face of the ventilator 3. When the handle 28 is moved out of the housing, the shaft 26 is moved in axial direction so that the pinion 27 will come into engagement with the gear ring 30. The arm 25 of the locking slide 22 is connected by means of a rod 31 with the switch 4. For this connection, a pin 32 affixed to the switch 4 is provided, and the rod 31 is provided with an elongated slot 33, in which the pin 32 engages. The length of the slot 33 and the position thereof as well as the position of the pin 32, are chosen in such a manner that the switch 4 may be properly actuated when the shaft 26 and therewith the locking slide and the rod 31 are in a position as shown in FIG. 1. FIG. 2 shows also a guard 34 for the cutting disk 17.

In order to release the clamping of the cutting disk 17, the shaft 26 is moved by the handle 28 partly out of the housing 1 until the pinion 27 meshes with the gear ring 30 and the locking slide 22 engages in one of the locking grooves 21 in the clamping flange 14, whereby the switch 4 by means of the rod 31 is moved to and blocks in a position in which the drive motor is disconnected. If now the shaft 26 is turned about its axis by means of the handle 28, the tool spindle 5 is turned over the pinion 27, the gear ring 30, the ventilator 3, the motor shaft 7, the bevel gear 8 and the bevel gear 9 in such a manner that, since the clamping flange 14 is prevented from rotating and therewith also the clamping nut 16, the latter is axially shifted due to its threaded connection with the spindle tenon 13 to release thereby the clamping of the disk 17. During further turning of the shaft 26 or by manually engaging the clamping nut 16 the latter may be fully detached from the spindle 10 and 13. The disk 17 can now be removed and be replaced by a new or different cutting disk. The new or other cutting disk can then be clamped by a threadingly connecting the clamping nut 16 to the threaded portion of the spindle 10 and 13 so that the small-diameter portion of the nut 16 passes in the bore 18 of the clamping flange 14. This may be performed by manually turning the clamping nut 16 until the latter pushes the clamping flange 14 slightly against the shoulder face 11 of the spindle 5. Thereafter, the shaft 26 is again moved by means of the handle 28 in its working position, in which the pinion 27 meshes with the gear ring 30 and the locking slide 22 engages in one of the locking grooves 21 provided in the clamping flange 14. During such movement of the locking slide 22, the switch 4 is again blocked by means of the rod 31 in a position in which the motor 2 is disconnected. An inadvertent connecting of the motor 2 is thus positively prevented. By turning the handle 28 now in the direction opposite the direction in which it is turned during the release of the clamping of the disk 17, it is now possible to tightly clamp the disk 17 between opposite faces of the clamping flange 14 and the clamping nut 16. Thereafter, handle 28 is released so that the shaft 26, the rod 31 and the locking slide 22 are returned due to the action of the coil spring 29 again to the position as shown in FIG. 1, in which the handle abuts again against a portion of the housing 1.

In the modification illustrated in FIGS. 3 and 4, the clamping arrangement actuated by the handle 28 is replaced by another clamping arrangement. In this modification, a clamping element 35 takes over the task to prevent the clamping flange 14 from rotation by engaging in a longitudinally extending locking groove 21 of the latter. The clamping element 35 is provided with an actuating pin 36 projecting therefrom. The clamping element 35 is under the action of a spring pad 37 which biases the element 35 to a rest or inactive position. In order to bring the locking element 35 to the active position in which it engages in the locking groove 21, the pin 36 is pressed inwardly. A drive lever 38 is mounted in the region of the ventilator 3 for tilting movement about a pin 43 arranged between opposite ends of the drive lever 38. One lever arm 39 of the drive lever 38 is constructed as a handle, whereas the other lever arm forms a drive finger 40. This drive finger is arranged so that it may engage between the vanes 41 of the ventilator during turning of the drive lever 38 about the pivot pin 43 in clockwise direction. A tab 42 connected to the free end of the lever arm 39 forms part of a spring catch for holding the drive lever 38 in its rest position without rattling against the housing 1.

In order to release the clamping of the disk 17, the pin 36 is pressed inwardly so that the locking element 35 will engage in the locking groove 21 of the clamping flange 14 to hold the latter and therewith also the clamping nut 16 against rotation with respect to the tool spindle 5. Subsequently thereto, the drive lever 38 is turned in a clockwise direction about the pin 43 until the drive finger 40 engages between the vanes 41 of the ventilator 3. During further tilting of the drive lever 38, the ventilator 3 and therewith the spindle 5 is turned in counterclockwise direction, so that the clamping nut 16 will move axially away from the disk 17. The pin 36 is then released so that the locking element 35 is moved by the action of the spring pad 37 again to the position as shown in FIG. 3 in which the locking element 35 is out of engagement with the locking grooves 21 in the clamping flange 14, while the drive lever 38 is moved back to the position as shown in FIG. 4 in which it is held by the tab 42. The clamping nut 16 may then be manually unscrewed from the threaded end portion of the spindle tennon 13. A safety device 44 holds the clamping flange 14 on the spindle tennon 13 against movement in axial direction. To remove the disk 17 from the tennon 13, it is then only necessary to manually further unscrew the clamping nut 16. A new or other cutting disk 17 is then pushed onto the small-diameter portion of the clamping nut 16 and the latter is then again screwed onto the threaded portion 15 of the tennon 13. Care has to be taken thereby that the entrainment pin 21 is properly engaged in the longitudinal groove 19 of the clamping nut 16. After the clamping nut 16 is slightly tightened by hand, the drive lever 38 is released from its rest position shown in FIG. 4 and turned beyond a position in which the drive finger 40 engages between the vanes 41 of the ventilator 3. Subsequently thereto, the locking element 35 is brought into its locking position by inwardly pressing the pin 36 so that the locking element 35 engages into the locking groove 21 of the clamping flange and holds the latter and thereby also the clamping nut 16 against rotation with respect to the spindle 5. Subsequently thereto, the drive lever 38 is pivoted about the pin 43 back to its position as shown in FIG. 4, turning thereby the ventilator 3 in clockwise direction to thereby move the spindle 5 in a direction in which the clamping nut 16 is further tightened to thereby clamp the disk 17 between the adjacent faces of the clamping flange 14 and the clamping nut 16. Thereafter the pin 36 is released so that the locking element 35 moves out of engagement with the locking groove 21 in the clamping flange 14 under the action of the spring pad 37.

Figure 5:
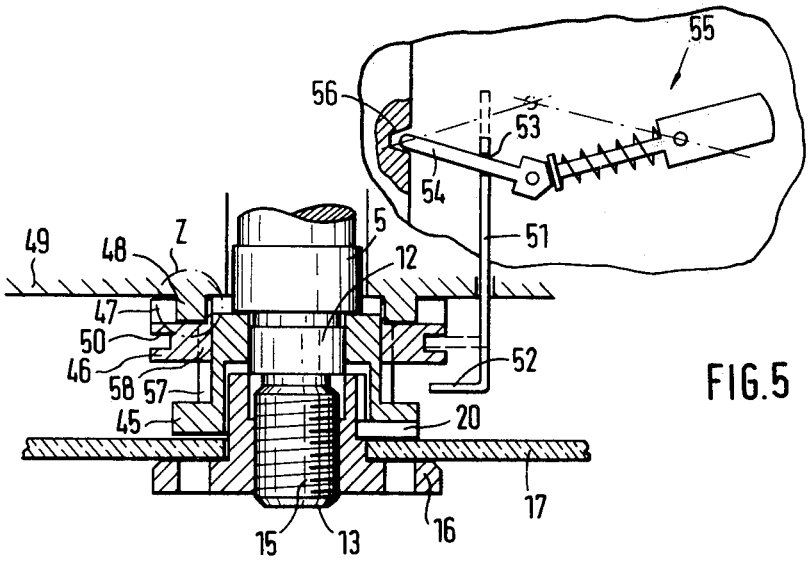
FIG. 5 is a section through part of a third embodiment.
Figure 6:
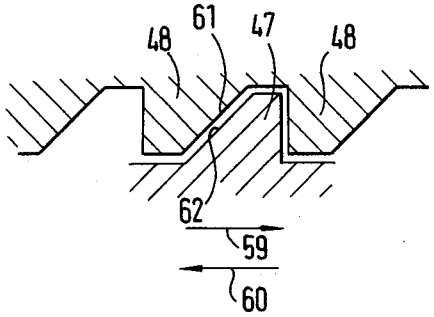
FIG. 6 illustrates an end view of the portion Z of FIG. 5 at an enlarged scale.

In the third embodiment illustrated in FIGS. 5 and 6, there is described a clamping arrangement which can operate without manually turning the tool spindle 5. In this third embodiment illustrated in FIGS. 5 and 6, a modified clamping flange 45 carries an arresting ring 46, connected thereto against rotation about the axis of the clamping flange but axially movable with respect to the latter. The arresting ring 46 is provided with arresting teeth 47 which face corresponding arresting teeth 48 provided on the stationary bearing flange 49 of the bearing for the tool spindle 5. The arresting ring 46 is further provided with an annular groove 50 extending from the outer periphery of the arresting ring 46 into the latter. A slide 51 guided in the housing 1 for movement in longitudinal direction has an end portion 52 including an angle of substantially 90° with the remainder of the slide 51 and this end portion 52 is engaged in the annular groove 50 of the arresting ring 46. The slide 51 is mounted in the housing 1 for movement parallel to the longitudinal axis of the spindle 5. The slide 51 is provided in the region of the end opposite to the end in which the end portion 52 is formed with an opening 53. A lever 54 of a snap-action device 55 passes through the opening 53. The free end of this lever 54 is held in a cavity 56 provided in the housing 1. In the position of the snap-action device 55 shown in full lines in FIG. 5, the slide is moved in downward direction and therewith the arresting ring 46 disengages from the bearing flange 49. When the lever 54 of the snap-action device 55 is moved to the position indicated in FIG. 5 in dash-dot lines, the arresting ring 46 is moved to the position as shown in FIG. 5 in dotted lines, in which the arresting ring 46 is moved to a position in which the locking teeth 47 thereon engage with the locking teeth 48. FIG. 6 further illustrates the construction of the locking teeth 47 and 48 in cross section. The connection between the clamping flange 45 and the arresting ring 46 is accomplished by a plurality of circumferentially displaced longitudinally extending webs 57 engaging in corresponding grooves 58 on the arresting ring 46.

The drive motor 2 in the modification as shown in FIGS. 5 and 6 is a reversible two-speed electric motor of known construction. To release the clamping arrangement for the cutting disk 17, the snap-action device 55 is manually moved to its upper position shown in dash-dotted lines in FIG. 5, so that the slide 51 moves the arresting ring 46 into coupling position in which the teeth 47 on the arresting ring 46 engage with the teeth 48 on the bearing flange 49. Subsequently thereto, the two-speed reversible drive motor is switched by means known in the art and not illustrated in the drawing to turn slowly in counterclockwise direction. The loading direction resulting therefrom of the arresting ring 46, acting over the arresting teeth 47 and 48, is indicated in FIG. 6 by the arrow 59. It is to be understood that the tool spindle 5 is connected to the drive shaft of the reversible two-speed motor in the manner as described in connection with FIG. 2. As will be evident from FIG. 6, the arresting ring 46 is in this case held stationary, which results also that the clamping flange 45, connected to the arresting ring 46 as above described, is likewise prevented from rotation about its axis and there-with also the clamping nut 16, due to the engagement of the pin 70 on the clamping flange 45 in a longitudinal groove provided in the smaller-diameter portion of the clamping nut 16 in the manner as described above in connection with FIG. 2. In this way, the clamping nut 16 will, during rotation of the spindle 5, unscrew from the threaded portion 15 of the spindle tenen 13 so that clamping of the disk 17 is released. In order to clamp a new or other disk 17 on the tennon 13, the snap-action device 55 is maintained in its upper position shown in dash-dot lines in FIG. 5. The drive motor of the machine tool is then switched for slow movement in clockwise direction, whereby over the locking teeth 47 and 48 a turning movement is exerted on the arresting ring 46 in the direction as indicated by the arrow 60 in FIG. 6. The arresting ring 46 is thereby over the inclined faces 61 of the teeth 48 arrested, onto which the inclined faces 62 of the teeth 47 abut. After the necessary turning movement for clamping of the disk 17 is reached, the inclined faces 62 of the teeth 47 slide over the inclined faces 61 of the teeth 48, whereby the arresting ring 46 is moved in axial direction to the uncoupled position shown in full lines in FIG. 5. Thereby the lever 45 of the snap-action device 55 is moved by means of the slide 51 until the snap-action device 55 is moved beyond its labile middle position. The complete uncoupling of the arresting means 46 from the bearing flange 49 is accomplished by the snap-action device 55 which is now moving in the lower end position. The disk 17 is thereby clamped with a predetermined moment and can now in the same turning direction move and be used for performing its desired work. For the renewed release of the disk 17, the snap-action device is to be manually reversed again.

It will be understood that each of the elements described above, or two or more together, may also find a useful application in other types of machine tools differing from the types described above.

While the invention has been illustrated and described as embodied in a machine tool, especially a handheld power tool in which a cutting disk or the like is clamped between a clamping flange and a clamping nut and in which an arrangement is provided for turning the clamping nut in one or the other direction with respect to a threaded end portion of the tool spindle for clamping or releasing the disk, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a machine tool, especially a hand-held power tool, a combination comprising a housing; a tool spindle mounted in the housing for rotation about its axis; means on the tool spindle including a clamping element turnably mounted on said spindle for clamping a tool on the latter for rotation therewith; manually operated means for turning said spindle about its axis; arresting means movable between a rest position and an arresting position for holding said clamping element against rotation during turning of said spindle for clamping or for releasing a tool, said manually operated turning means being movable between an inactive position and an active position turning said tool spindle and means cooperating with said manually operated turning means and said arresting means for moving said turning means to said active position during movement of said arresting means to said arresting position and vice versa; a drive motor operatively connected to said spindle; a switch for switching said drive motor on sand off; and connecting means connecting said switch with said manually operable turning means and said arresting means for switching said drive motor off when said turning means is moved to the active and said arresting means to said arresting position.

2. In a machine tool, especially a hand-held power tool, a combination comprising a housing; a tool spindle mounted in the housing for rotation about its axis; means on the tool spindle including a clamping element turnably mounted on said spindle for clamping a tool on the latter for rotation therewith; means for turning said spindle about its axis and including a motor which is a reversible two-speed electric motor shiftable to a low speed during clamping or releasing of the tool and rotatable in one direction during clamping of the tool and in the opposite direction during release of the tool; and arresting means movable between a rest position and an arresting position for holding said clamping element against rotation during turning of said spindle for clamping or for releasing a tool, said arresting means being formed to release said clamping element during clamping of the tool when the moment for clamping the tool on the spindle surpasses a predetermined amount, and to be turned by said motor when the latter is rotated in the opposite direction for releasing the tool without limiting the moment imparted by the motor to said arresting means.

3. In a machine tool, especially a hand-held power tool, a combination comprising a housing; a tool spindle mounted in the housing for rotation about its axis and having an end portion provided with a screwthread, said tool spindle having rearwardly of said end portion a shoulder face; means on the tool spindle including a clamping element turnably mounted on said spindle for clamping a disc-shaped tool on the latter for rotation therewith and threadedly connected with said screwthread so as to be rotatably axially shiftable with respect to said spindle for clamping the tool on the latter for rotation therewith, said clamping element being constituted by a clamping nut on said threaded end portion of said spindle and adapted to engage the tool on the side thereof facing away from said shoulder face, and including a clamping flange arranged on said spindle and adapted to engage the tool on the other side thereof; means connecting said clamping nut and said clamping flange for rotation and axially shiftable with respect to each other, whereby during rotation of said spindle in one direction while said arresting means is in its arresting position said clamping nut will be moved towards said shoulder face and said clamping flange against the latter to clamp the tool between said clamping nut and said clamping flange; means for turning said spindle about its axis; and arresting means movable between a rest position and an arresting position for holding said clamping element against rotation during turning of said spindle for clamping or for releasing a tool.

4. A combination as defined in claim 3, wherein said clamping flange is provided with circumferentially spaced grooves extending in the longitudinal direction of the clamping flange.

5. A combination as defined in claim 4, and including a shaft turnably and axially shiftably mounted in said housing, a pinion fixed to one end of said shaft for rotation therewith, and a handle connected to the other end of said shaft for axially moving the latter between a rest position and a working position, a gear ring operatively connected to said spindle for rotating the latter during rotation of said gear ring and slide means movable between an arresting position holding said clamping flange against rotation and a releasing position, said pinion and said gearing ring being arranged with respect to each other and said slide means being connected to said shaft such that in said rest position of said shaft said pinion and said gear ring are disengaged from each other while said slide means is moved to said releasing position and such that in said working position of said shaft said pinion engages said gear ring to drive the latter and therewith said spindle while said slide means is moved to said arresting position holding said clamping flange and therewith said clamping nut against rotation.

6. A combination as defined in claim 5, wherein said handle abuts in said rest position of said spindle against a portion of said housing and is lifted from said housing in said working position of said spindle.

7. A combination as defined in claim 5, and including a motor for driving said gear ring and therewith said spindle, a switch movable between a first position for energizing said motor and a second position for deenergizing the latter, and means connecting said shaft with said switch for blocking said switch in said second position when said shaft is in said working position and for releasing said switch so that the latter is movable from said second to said first position when said shaft is in said rest position.

8. A combination as defined in claim 5, and including spring means cooperating with said shaft for biasing the latter to said rest position.

9. A combination as defined in claim 3, wherein said turning means are manually operated means.

10. A combination as defined in claim 9, wherein said manually operated turning means are movable between an inactive position and an active position turning said tool spindle and means cooperating with said manually operated turning means and said arresting means for moving said turning means to said active position during movement of said arresting means to said arresting position and vice versa.

11. A combination as defined in claim 3, wherein said turning means comprises a motor.

12. A combination as defined in claim 11, wherein said motor is a reversible two-speed electric motor shiftable to a low speed during clamping or releasing of the tool and rotatable in one direction during clamping of the tool and in the opposite direction during release of the tool.

13. A combination as defined in claim 12, wherein said arresting means is constructed to release said clamping element during clamping of the tool when the moment for clamping the tool on the spindle surpasses a predetermined moment.

14. A combination as defined in claim 3, wherein said tool spindle has an end portion provided with a screwthread, and wherein said clamping element is threadedly connected with said screwthread so as to be rotatably axially shiftable with respect to said spindle for clamping the tool on the latter for rotation therewith.

15. A combination as defined in claim 3, and including slide means for holding said clamping flange and therewith said clamping nut against rotation about said spindle and means separated from said slide means for manually turning said spindle about its axis.

16. A combination as defined in claim 3, and including an arresting ring carried by said clamping flange axially movable but non-rotatable with respect thereto and being provided with angularly displaced arresting teeth, bearing means for mounting said spindle for rotation about its axis and having an end face directed towards said clamping flange and angularly displaced teeth projecting from said end face, and a snap-action device connected to said arresting ring for moving the latter between a first position in which said arresting teeth thereon are axially spaced from said teeth on said end face of said bearing means and a second position in which said arresting teeth are interengaged with said teeth on said end face, 17. In a machine tool, especially a hand-held power tool, a combination comprising a housing; a tool spindle mounted in the housing for rotation about its axis and having an end portion provided with a screwthread, said tool spindle having rearwardly of said end portion a shoulder face; means on the tool spindle including a clamping element turnably mounted on said spindle for clamping a disc-shaped tool on the latter for rotation therewith and threadedly connected with said screwthread so as to be rotatably axially shiftable with respect to said spindle for clamping the tool on the latter for rotation therewith, said clamping element being constituted by a clamping nut on said threaded end portion of said spindle and adapted to engage the tool on the side thereof facing away from said shoulder face, and including a clamping flange arranged on said spindle and adapted to engage the tool on the other side thereof; means for turning said spindle about its axis; arresting means movable between a rest position and an arresting position for holding said clamping element against rotation during turning of said spindle for clamping or for releasing a tool; slide means for holding said clamping flange and therewith said clamping nut against rotation about said spindle; means separated from said slide means for manually turning said spindle about its axis; a ventilator having a plurality of angularly displaced vanes and being operatively connected to said spindle for rotating the latter during rotation of said ventilator, said means for manually turning said spindle comprising a lever mounted on said housing for tilting about a pivot pin between an inactive and a driving position and having to one side of said pivot pin a handle portion and at the other side of said pivot pin a drive finger arranged and dimensioned in such a manner that during tilting of said lever from said inactive to said driving position said drive finger will engage between the vanes of said ventilator to turn the latter and therewith said spindle operatively connected to said ventilator.

18. A combination as defined in claim 17, wherein said handle portion of said lever is formed to engage in the inactive position of said lever the outer surface of said housing and including means for releasably holding said handle portion of said lever in the inactive position of the latter closely adjacent to the outer surface of said housing.

* * * * *